United States Patent [19]

Boehm et al.

[11] 4,321,088

[45] Mar. 23, 1982

[54] PROCESS FOR TREATING PIG IRON MELTS AND STEEL MELTS OR ALLOYS

[75] Inventors: Georg Boehm, Heddesheim; Engelbert Hillenbrand, Heppenheim, both of Fed. Rep. of Germany

[73] Assignee: BASF Aktiengesellschaft, Fed. Rep. of Germany

[21] Appl. No.: 35,318

[22] Filed: May 2, 1979

[30] Foreign Application Priority Data

May 11, 1978 [DE] Fed. Rep. of Germany ..... 2820555

[51] Int. Cl.[3] ..... C21C 5/34; C21C 7/04

[52] U.S. Cl. ..... 75/59; 75/60

[58] Field of Search ..... 75/59, 60

[56] References Cited

U.S. PATENT DOCUMENTS

| | | | |
|---|---|---|---|
| 3,046,107 | 7/1962 | Nelson | 75/59 |
| 3,598,383 | 8/1971 | Moore | 75/53 |
| 3,598,573 | 8/1971 | Freissmuth | 75/53 |
| 3,640,702 | 2/1972 | Karinthi | 75/53 |
| 3,861,888 | 1/1975 | Heise | 75/60 |
| 3,932,172 | 1/1976 | Knuppel | 75/60 |

*Primary Examiner*—P. D. Rosenberg

*Attorney, Agent, or Firm*—Keil & Witherspoon

[57] ABSTRACT

A process for treating pig iron melts and steel melts or alloys in a converter, crucible or other vessel, wherein the entire refining and treatment process is carried out in a vessel with carbon dioxide, continuously and up to the finishing of the steel. Liquid carbon dioxide under a pressure of from 4.0 to 20.0 bar is used for the treatment. From about 50 to 300 kg of $CO_2$/tonne of steel are required for the refining of the pig iron melt.

8 Claims, 4 Drawing Figures

PROCESS FOR TREATING PIG IRON MELTS AND STEEL MELTS OR ALLOYS

Figure 1:
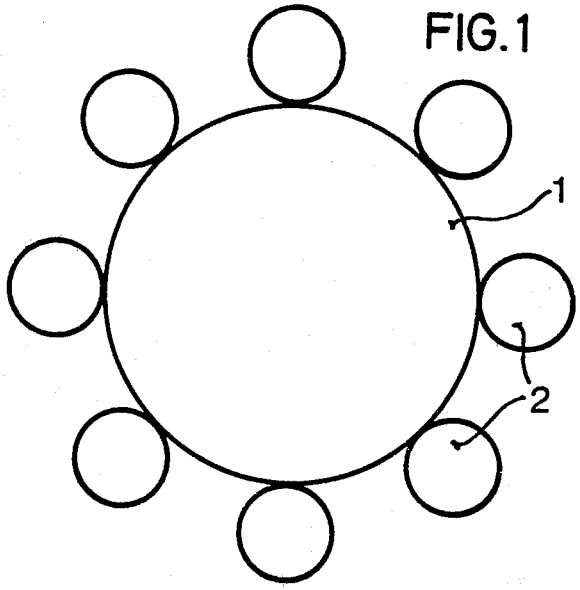

The conventional processes for refining pig iron melts are based either on blowing pure oxygen onto the melt, as, for example, in the LD process, which employs an oxygen lance, or blowing oxygen into the melt through a plurality of nozzles located in the converter bottom, as, for example, in the OBM process. In most cases, the steels thus produced must be subjected to an after-treatment in order to improve their purity or to reduce the gas content. A disadvantage of this oxygen blowing proces is the severe overheating of the melt, which in particular causes the converter lining to suffer. Especially, the particles originating from the lining contaminate the steel melt.

We have found, surprisingly, that these disadvantages of the oxygen treatment can be avoided and the refining and the after-treatment of the steel melt can be carried out continuously in one process step, if instead of oxygen carbon dioxide is used.

The use of gas mixtures for refining pig iron melts in the Thomas and Bessemer processes has been disclosed. For example, German Pat. No. 951,007, Belgian Pat. No. 471,142, French Pat. No. 960,034 and British Pat. No. 869,953 describe various processes for producing low-nitrogen steels by blowing gas mixtures into the pig iron melt. However, all these proceses concern limited metallurgical steps, for example refining, but not a continuous process for the manufacture of steels, having defined properties, in one process step.

In a preferred embodiment of the process according to the invention, from about 50 to 300 kg of $CO_2$/tonne of pig iron about 0.06 to 0.40 moles of $CO_2$ for each mole of iron are blown onto or into the melt during the first blowing period, namely the refining, and when the carbon content has fallen to 0.3% by weight a flushing treatment with from 0.25 to 50.0 kg of $CO_2$/tonne of steel melt is carried out as an after-treatment. The flushing is advantageously continued until the analytical data conform to the relevant DIN standard specification. At the same time, the flushing not only reduces undesirable gas contents but also substantially improves the purity of the melt. As a result, steels which have reproducible properties and are of high quality are produced.

In the process according to the invention, the following reactions take place in the pig iron melt on treatment with carbon dioxide:

1. $Fe + CO_2 \rightarrow FeO + CO$
2. $FeO + C \rightarrow Fe + + CO$
3. $CO_2 + C \rightarrow 2\,CO - 38{,}360$ *kcal/kmole*

It can be seen from the overall equation that the reaction is endothermic and that the carbon dioxide used for the treatment cannot cause any overheating of the pig iron melt. The melt is even cooled somewhat by the cold $CO_2$ gas blown in. Accordingly, not only is less contaminant carried from the converter lining into the steel melt, but the life of the vessels is also substantially increased compared to the conventional oxygen refining process.

Using the process according to the invention, the contents of elements which are detrimental to steel, for example phosphorus and sulfur, can also be effectively lowered or eliminated entirely. On treatment with $CO_2$ gas, these elements react in accordance with the following equations:

1. $2\,P + 5\,CO_2 \rightarrow P_2O_5 + 5\,CO + 26{,}045$ cal
2. $S + 2\,CO_2 \rightarrow SO_2 + 2\,CO - 44{,}394$ cal The ascending flushing gas removes the resultng oxides from the melt and leads them continuously into the slag covering.

The refining with gaseous carbon dioxide can be carried out in the conventional manner by blowing the carbon dioxide onto or into the pig iron melt. However, in some cases it is more advantageous to blow liquid or solid carbon dioxide onto or into the pig iron melt. According to the invention, liquid carbon dioxide can be introduced into the melt under pressure by means of one or more nozzles present in the converter. The liquid carbon dioxide can also be blown into the melt in the form of small droplets together with the $CO_2$ gas. The pressure of the $CO_2$ gas or $CO_2$ gas mixture upstream of the nozzle is from 0.2 to 20 bar, depending on the size of the vessel. In some cases it has proved useful to admix another gas, for example an oxidizing, reducing or inert gas, to the pure carbon dioxide. By using gas mixtures of different compositions, the temperature pattern of the reaction can be controlled and the course of the reaction optimized; in particular, this provides a simple method of avoiding overheating of the melt. For example, in the case of certain pig iron melts which exhibit a high silicon or manganese content, oxygen can be added to the $CO_2$ gas in order to accelerate the combustion of the said elements.

The process described is not restricted to unalloyed steels. Alloyed steels can be treated with $CO_2$ in the same way. The use of $CO_2$ gas for the fine decarburizing of high-chrome steels by the AOD process has proved particularly advantageous. In this process, more effective and more rapid decarburizing was achievable with $CO_2$ than with oxygen, both in the first and in the second treatment stage.

According to the invention, carbon dioxide can be blown into a pig iron melt through a single nozzle or a plurality of nozzles. For example, either gaseous carbon dioxide or only liquid carbon dioxide under pressure can be blown into the melt through a single nozzle. However, in practice it has proved advantageous to blow liquid and gaseous carbon dioxide simultaneously through a single nozzle into the melt. If a plurality of gases is employed for refining a pig iron melt, multiple nozzles are preferred.

FIG. 1 shows a cross-section through such a nozzle. It has proved advantageous to blow the carbon dioxide in through the middle nozzle 1. The outer nozzles 2 serve to blow in gaseous oxygen or other gas admixtures.

Figure 4:
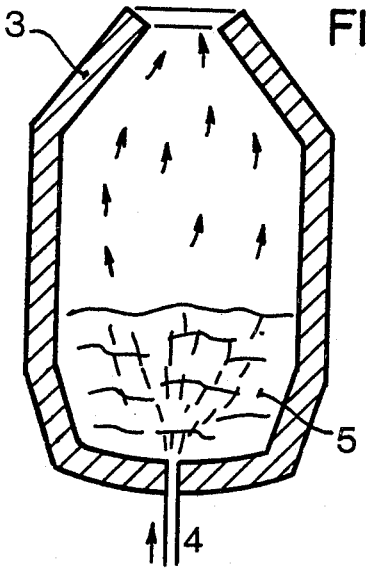
Figure 2:
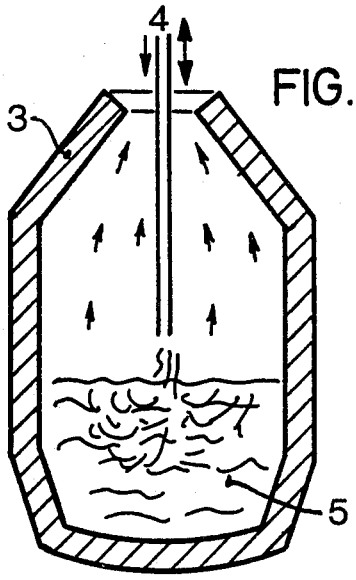
Figure 3:
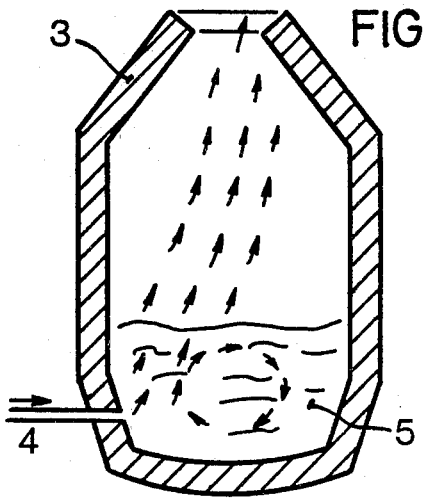

FIGS. 2 to 4 show possible arrangements of the nozzles. In each case, the nozzle can be arranged vertically either movably or fixedly in the converter 3.

For example, FIG. 2 shows a movable arrangement of the nozzle 4. The nozzle is introduced before refining and withdrawn after completion of the process. In FIG. 3, the nozzle 4 is located at the side, whilst in FIG. 4 it is located in the converter bottom. Whilst the nozzle arrangements shown in FIGS. 2 and 4 are used for refining and flushing a pig iron melt 5 in order to produce substantially unalloyed steels, the lateral arrangement of the nozzle shown in FIG. 3 results in vigorous circulation, which accelerates not only the fine decarburizing but also the flushing of high-alloy steels.

The invention is further illustrated by the three embodiments of the novel process described below.

EXAMPLE 1

A steel melt of the following chemical composition is refined with carbon dioxide in a crucible of 5 kg capacity.

| Elements | C | Si | Mn | P | S | Fe |
|---|---|---|---|---|---|---|
| % by weight | 4.46 | 0.70 | 0.67 | 0.116 | 0.026 | remainder |

The melt is treated with 0.2 kg of $CO_2$/kg of pig iron for about 15 minutes. A steel of type St 55 (Material No. 1.0507) of the following composition is obtained:

| Elements | C | Si | Mn | P | S | Fe |
|---|---|---|---|---|---|---|
| % by weight | 0.31 | 0.24 | 0.47 | 0.030 | 0.020 | remainder |

The melt is then flushed with 0.02 kg of $CO_2$/kg of steel in the same vessel for a further 5 minutes, giving the following degree of purity:

| Sample No. | Number of inclusions (F) before flushing | Number of inclusions (F) after flushing | ΣF of inclusions, in $\mu m^2$ before flushing | ΣF of inclusions, in $\mu m^2$ after flushing | F inclusions in % . 10-5 before flushing | F inclusions in % . 10-5 after flushing | Improvement in purity, % |
|---|---|---|---|---|---|---|---|
| 1 | 10,555 | 1,821 | 98,597 | 38,505 | 1,111 | 434 | 60.9 |
| 2 | 10,138 | 1,194 | 99,916 | 44,329 | 1,126 | 499 | 56.1 |
| 3 | 12,456 | 1,609 | 113,486 | 40,412 | 1,279 | 455 | 64.4 |

Accordingly, the purity of this steel can be improved by more than 60%. The gas content of the melt can be reduced to the following values by the treatment with $CO_2$ gas described above:

| | $H_2$ | $H_2$ |
|---|---|---|
| after flushing | 3.1 ppm | 0.007 vol . ppm |

The steel thus produced has satisfactory properties and gives no problems in conversion to pipes.

EXAMPLE 2

The steel melt mentioned in Example 1 is refined and then treated further with 0.2 kg of $CO_2$/kg of steel for 25 minutes. This allows the carbon content, the phosphorus content and the sulfur content to be lowered yet further, as shown by the Table which follows:

| Elements | C | Si | Mn | P | S | Fe |
|---|---|---|---|---|---|---|
| % by weight | 0.03 | 0.18 | 0.40 | 0.038 | 0.004 | remainder |

This steel possesses high ductility and particularly good toughness characteristics.

EXAMPLE 3

A high-chrome nickel-containing pig iron melt is refined with $CO_2$ in the manner described, until the carbon content has been lowered to about 1.3%. The melt is then treated with a gas mixture consisting of 6 parts by volume of $CO_2$ and 1 part by volume of Ar for about 30 minutes, which lowers the carbon content to 0.6%. In the subsequent period of treatment the ratio of volume of $CO_2$/volume of Ar is reduced to 4%. After flushing for 35 minutes, the carbon content has been reduced to 0.13%. The melt is then treated further with oxygen and argon in a volume ratio of 1:1. A stainless steel having the following composition is obtained.

| C | Si | Mn | Cr | Ni | Fe |
|---|---|---|---|---|---|
| 0.07 | 1.02 | 1.98 | 18.4 | 10.3 | remainder |

The steel produced as described above corresponds to Material No. 1.4301 and on subsequent analysis exhibits excellent purity. Furthermore, the steel block can be further processed satisfactorily. The end product exhibits not only conspicuously good corrosion resistance but also good surface characteristics.

Surprisingly, no clouds of red smoke are observed on treating pig iron melts in accordance with the invention. This can be explained by the fact that the carbon monoxide leaving the melt is immediately oxidized to carbon dioxide and suppresses the combustion of the fine iron particles. As a result, the rather expensive filter installations prescribed for the removal of such red smoke can be dispensed with.

We claim:

1. A refining and treatment process for substantially removing carbon and other oxidizable impurities from ferrous melts in a metallurgical vessel, comprising a step (a) wherein a reactant consisting essentially of carbon dioxide is blown into the melt in an amount of from about 0.06 to about 0.40 moles of $CO_2$ for each mole of iron.

2. The process of claim 1, comprising, in addition to (a), a subsequent treatment step (b) wherein a mixture consisting essentially of carbon dioxide and an inert or reducing gas is blown into the melt.

3. The process of claim 2, further comprising, in addition to and following steps (a) and (b), a subsequent step (c), wherein the melt is treated with a mixture consisting essentially of oxygen and argon to reduce the carbon content of the melt to below 0.1%.

4. The process of claim 1, 2 or 3, wherein the refining step (a) is continued until the carbon content of the melt has been lowered to about 1.3% and wherein the treatment step (b) is continued until the carbon content of the melt has been lowered to about 0.6%.

5. The process of claim 1, wherein refining step (a) comprises a first phase of blowing from about 0.06 to about 0.40 moles of $CO_2$ for each mole of iron until a carbon content of about 0.3% is reached and a second after-treatment phase of flushing the melt with from about 0.0003 to about 0.06 moles of $CO_2$ for each mole of iron until the desired carbon content is achieved.

6. The process of claim 1, 2 or 3, wherein the mixture consisting essentially of carbon dioxide and an inert or reducing gas contains at the start of treatment step six parts by volume of carbon dioxide and one part by volume of argon and wherein the carbon dioxide content by volume of the mixture is reduced during the course of treatment step (b) to about 4% of the volume of argon in said mixture.

7. The process of claim 1, 2 or 3, wherein liquid carbon dioxide under a pressure of from 4.0 to 20.0 bar is blown into the pig iron melt.

8. The process of claim 1, 2 or 3, wherein gaseous and liquid carbon dioxide are each blown into the pig iron melt through separate nozzles under a pressure of from 0.2 to 20 bar.

* * * * *